US007650704B2

(12) United States Patent
Richardson

(10) Patent No.: US 7,650,704 B2
(45) Date of Patent: Jan. 26, 2010

(54) FOOTWEAR SYSTEM WITH INTERCHANGEABLE PORTIONS

(76) Inventor: Margaret A. Richardson, 11734 Wilshire Blvd., #C1310, Los Angeles, CA (US) 90025-3750

( * ) Notice: Subject to any disclaimer, the term of this patent is extended or adjusted under 35 U.S.C. 154(b) by 720 days.

(21) Appl. No.: 11/403,165

(22) Filed: Apr. 12, 2006

(65) Prior Publication Data

US 2007/0240336 A1 Oct. 18, 2007

(51) Int. Cl.
*A43B 3/12* (2006.01)
*A43C 13/00* (2006.01)

(52) U.S. Cl. ..... 36/11.5; 36/15; 36/100

(58) Field of Classification Search ..... 36/11.5, 36/15, 100, 101, 136
See application file for complete search history.

(56) References Cited

U.S. PATENT DOCUMENTS

| | | | | | |
|---|---|---|---|---|---|
| 2,153,968 | A | | 4/1939 | Loufbahn | |
| 2,532,638 | A | * | 12/1950 | Niccoli | 36/11.5 |
| 2,607,133 | A | * | 8/1952 | Marlowe | 36/11.5 |
| 3,890,725 | A | * | 6/1975 | Lea et al. | 36/11.5 |
| 3,925,915 | A | | 12/1975 | Colli | |
| 4,114,296 | A | | 9/1978 | Smith | |
| 4,172,330 | A | * | 10/1979 | Kao | 36/11.5 |
| 4,193,214 | A | | 3/1980 | Wang | |
| 4,348,820 | A | | 9/1982 | D'Alessio | |
| 4,439,935 | A | | 4/1984 | Kelly | |
| 4,450,633 | A | | 5/1984 | Connelly | |
| 4,461,102 | A | | 7/1984 | DeVincentis | |
| 4,497,123 | A | * | 2/1985 | Ehrlich | 36/32 R |
| 4,712,319 | A | * | 12/1987 | Goria | 36/137 |
| 4,817,302 | A | | 4/1989 | Saltsman | |
| 4,839,948 | A | | 6/1989 | Boros | |
| 4,864,736 | A | * | 9/1989 | Bierk | 36/11.5 |
| 4,887,369 | A | | 12/1989 | Bailey et al. | |
| 5,463,823 | A | | 11/1995 | Bell et al. | |
| 5,673,501 | A | * | 10/1997 | Mathews | 36/136 |
| 5,852,885 | A | | 12/1998 | Ferniani | |
| 5,992,058 | A | | 11/1999 | Jneid | |
| 6,014,822 | A | | 1/2000 | Smith | |
| 6,349,486 | B1 | | 2/2002 | Lin | |
| 6,532,687 | B2 | | 3/2003 | Towns et al. | |
| 6,640,464 | B2 | | 11/2003 | Hsin et al. | |
| 6,651,359 | B1 | | 11/2003 | Bricker | |
| 6,769,204 | B1 | | 8/2004 | Phillips | |
| 6,848,199 | B1 | | 2/2005 | Giannelli | |
| 6,904,706 | B2 | | 6/2005 | Jones et al. | |

(Continued)

FOREIGN PATENT DOCUMENTS

| | | |
|---|---|---|
| EP | 0 022 898 A1 | 1/1981 |

(Continued)

*Primary Examiner*—Marie Patterson

(57) ABSTRACT

The present invention is directed to a footwear system that is customizable and offers a plurality of interchangeable base portions, upper portions, and connector elements in various styles, colors and designs, thus allowing an assortment of easily interchangeable and distinct styles of footwear in a single system. The footwear system specifically comprises an interchangeable base portion having a plurality of spaced openings and hollow receptacles formed in the base portion, an interchangeable upper portion adapted for removable attachment to the base portion where the upper portion has a plurality of spaced openings on each side end, and a plurality of interchangeable connector elements for connecting the upper portion to the base portion, where the connector elements may have decorative elements.

3 Claims, 12 Drawing Sheets

U.S. PATENT DOCUMENTS

| | | | | |
|---|---|---|---|---|
| 2002/0166258 | A1 | 11/2002 | Posa | |
| 2004/0128859 | A1* | 7/2004 | Cambronero | 36/11.5 |
| 2004/0128863 | A1 | 7/2004 | Hong et al. | |
| 2005/0016019 | A1 | 1/2005 | Smith et al. | |
| 2005/0039345 | A1 | 2/2005 | Jones et al. | |
| 2005/0223598 | A1 | 10/2005 | Jones et al. | |
| 2005/0274041 | A1 | 12/2005 | Collett et al. | |
| 2007/0245597 | A1* | 10/2007 | Krutilek et al. | 36/101 |
| 2008/0060110 | A1* | 3/2008 | Schmelzer et al. | 2/69 |
| 2008/0072456 | A1* | 3/2008 | Pearce | 36/101 |

FOREIGN PATENT DOCUMENTS

| | | | |
|---|---|---|---|
| EP | 0 080 783 | A1 | 6/1983 |
| EP | 0 734 844 | B1 | 10/1996 |
| EP | 0 894 446 | A1 | 2/1999 |
| WO | WO 02/089622 | A2 | 11/2002 |
| WO | WO 2004/043184 | | 5/2004 |
| WO | WO 2005/082190 | A1 | 9/2005 |
| WO | WO 2005/082192 | A1 | 9/2005 |
| WO | WO 2005/102091 | A1 | 11/2005 |

* cited by examiner

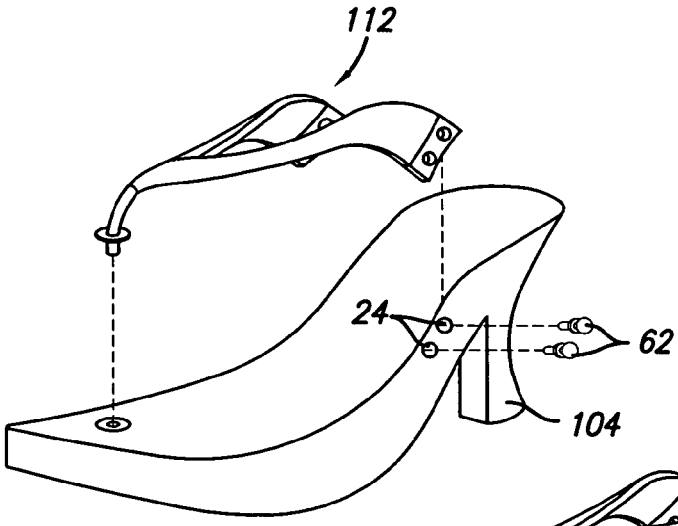
FIG. 19
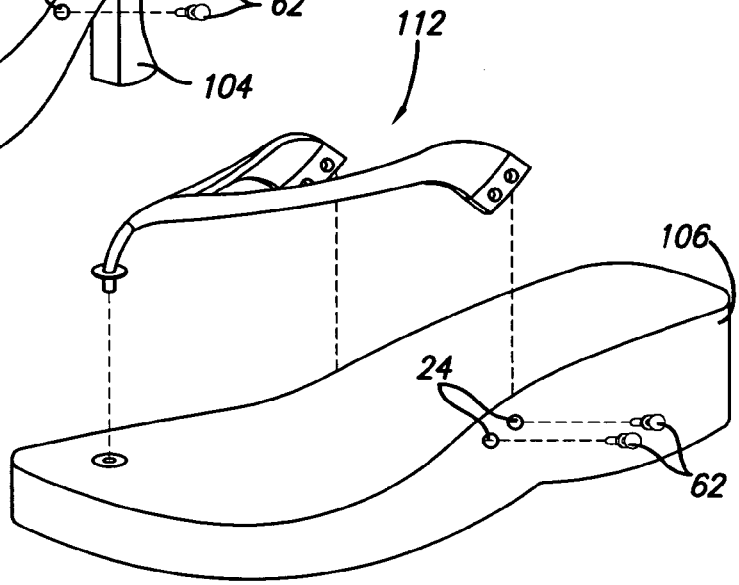
FIG. 20
FIG. 21
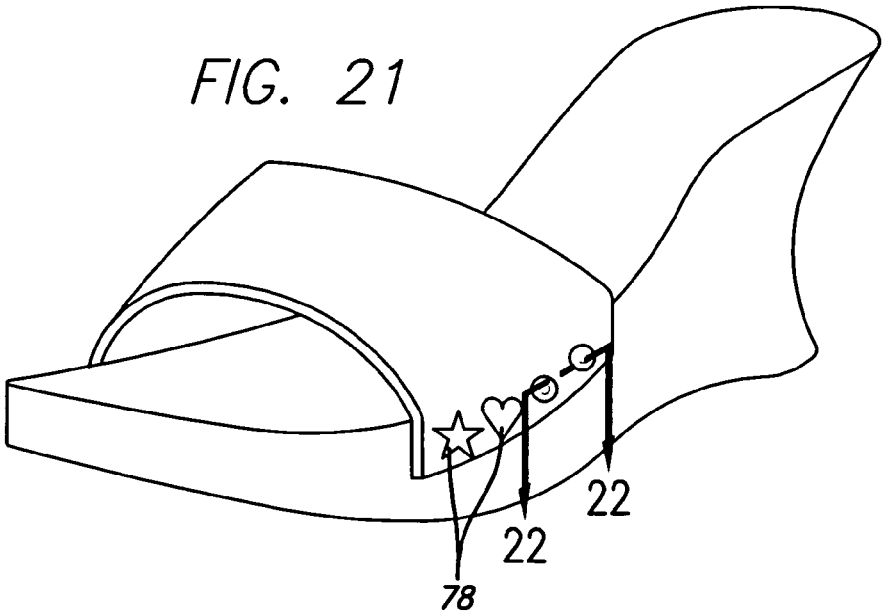

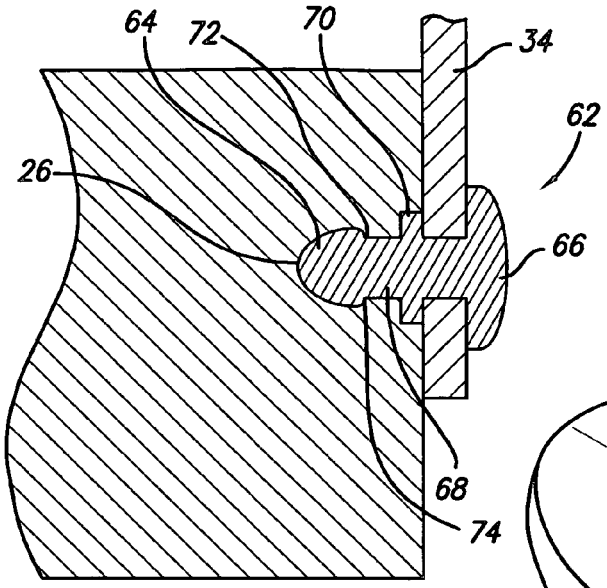
FIG. 22
FIG. 23
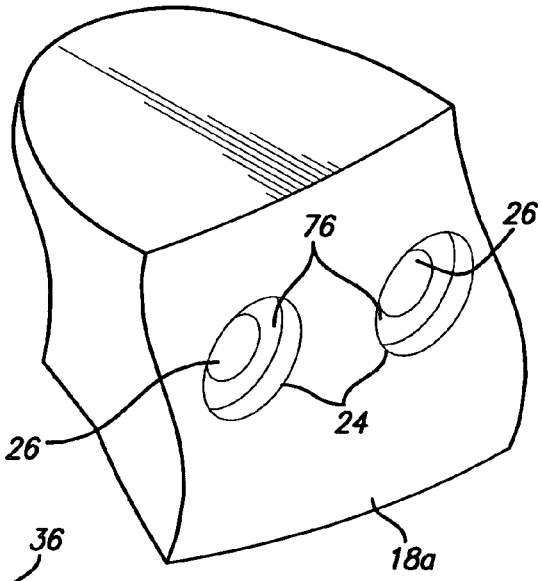
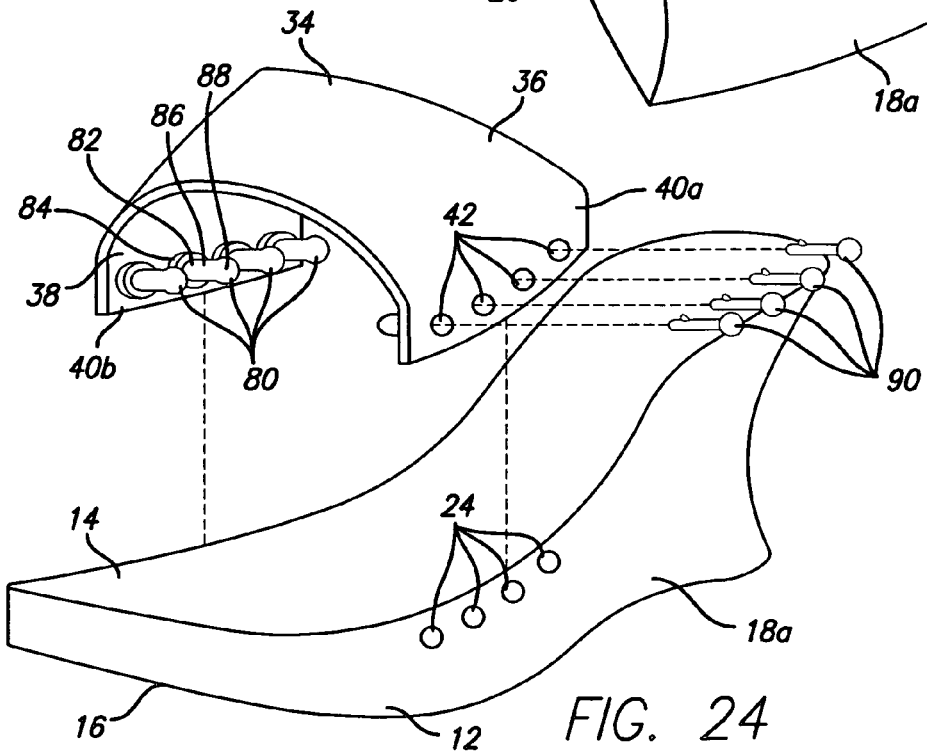
FIG. 24

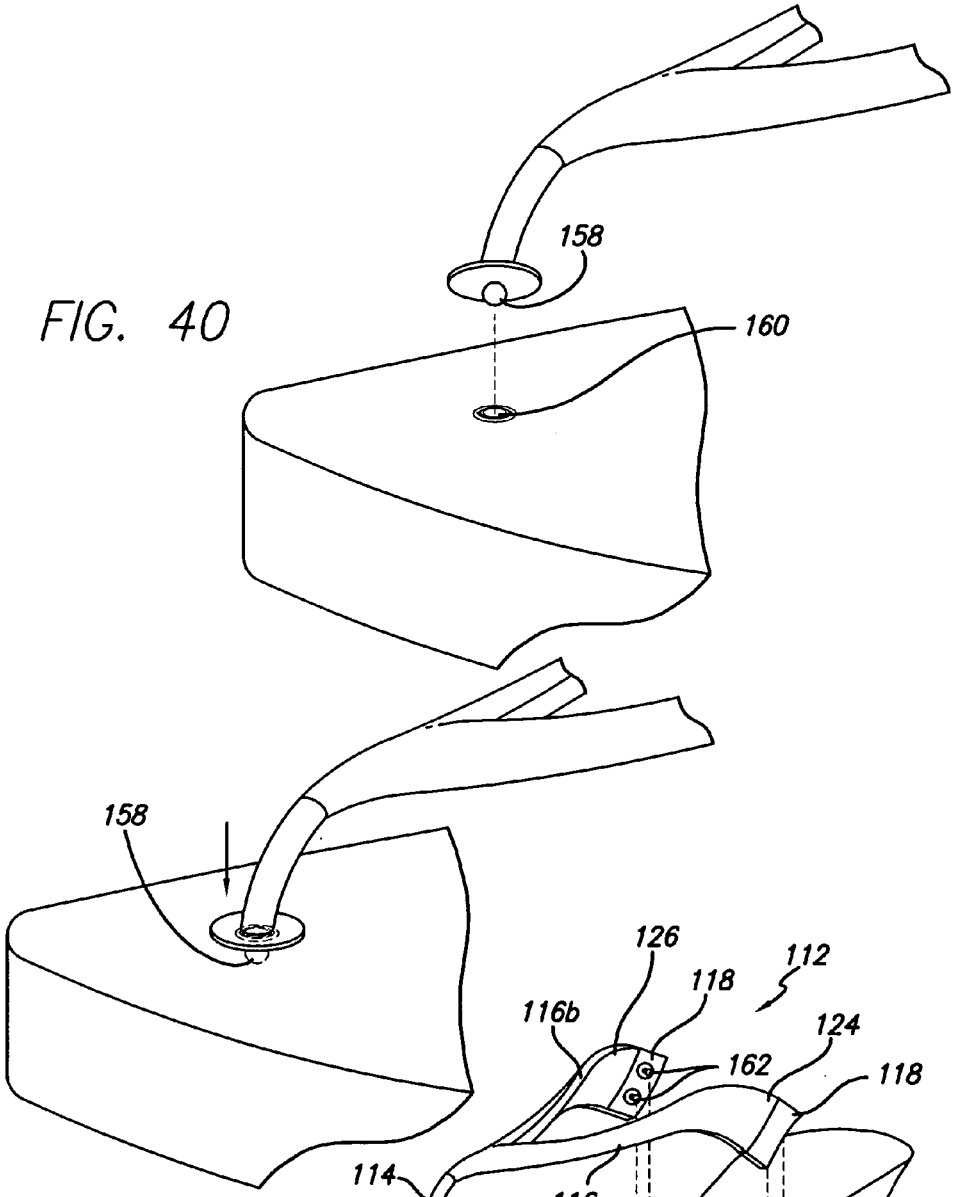
FIG. 40
FIG. 41
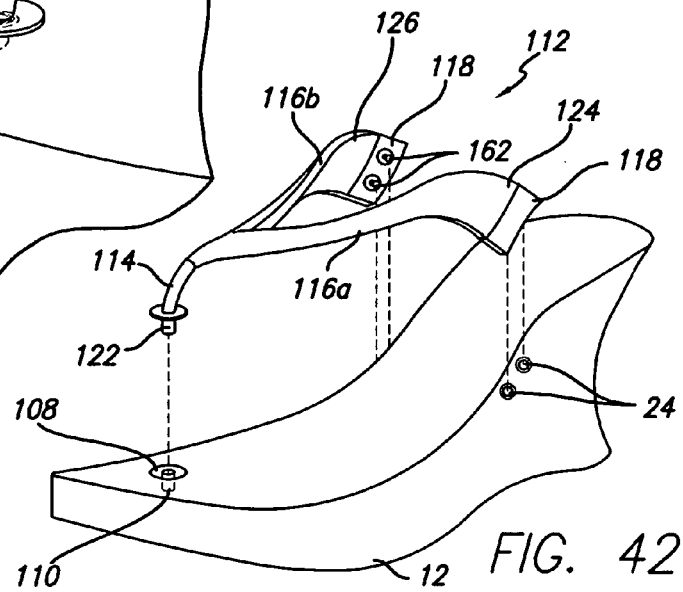
FIG. 42

FOOTWEAR SYSTEM WITH INTERCHANGEABLE PORTIONS

The subject matter described herein is directed to a footwear system with interchangeable portions. More particularly, the present invention is directed to a unique, novel, and nonobvious footwear system that enables a wearer to customize the wearer's footwear, preferably sandals, with easily interchangeable portions, such as a plurality of base portions, upper portions, and connector elements in a variety of styles, colors and designs to provide an assortment of footwear in a single system.

BACKGROUND OF THE INVENTION

Conventional sandal footwear typically includes a platform base with straps extending across the platform base and permanently secured within the platform base. Typically, the platform base is constructed of a plurality of elements forming a sandwich-type structure, with the ends of the straps secured within this structure by attachment means such as thread or glue. Such straps are typically not removable, and if the straps break, become soiled, or are no longer in fashion, the sandal footwear is often discarded, even though the platform bottom may still be capable of a much longer period of wear.

Moreover, women's footwear, particularly sandals such as slides and thongs, are very popular due to their style and comfort. In order to meet the demand for such footwear, footwear manufacturers and retailers must offer a large variety of fixed footwear designs and styles with non-interchangeable portions, thereby resulting in a substantial inventory cost. Equally problematic, if a woman wants to be in style with the latest fashions or coordinate her wardrobe, she has to buy many pairs of footwear resulting in additional expense.

Known footwear with interchangeable portions exist. Such known footwear includes sandals with interchangeable upper portions or vamps. However, the connector elements that connect the upper portion to the base of the sandal are typically of a complex construction, have numerous parts which increase the expense of manufacture and production, are difficult to remove and/or attach to the footwear base, and often break and easily detach. In addition, such connector elements are typically fixed, are not decorative, and do not allow a wearer to coordinate the connector with the interchangeable upper portion.

Accordingly, there is a need for a new and improved footwear system with interchangeable portions that does not have the problems associated with known footwear having interchangeable portions.

SUMMARY OF THE INVENTION

The present invention satisfies the need for a new and improved footwear system with interchangeable portions. None of the known footwear systems provide all of the numerous advantages of the present invention. Unlike known footwear systems, the footwear system with interchangeable portions of the present invention provides the following advantages: it is easy to use; it is inexpensive and efficient to manufacture; it enables manufacturers and retailers to offer numerous combinations of sandals and footwear with less monetary, space, and storage constraints; it provides a footwear system that is customizable and offers a plurality of interchangeable base portions, upper portions, and connector elements in various styles, colors and designs, thus allowing an assortment of easily interchangeable and distinct styles of footwear in a single system; it provides a footwear system where the base portions, upper portions and connector elements can be easily assembled and disassembled; it provides a footwear system that offers numerous styles of footwear in one system, and thus saves the wearer money by not having to buy numerous separate styles of footwear; it provides a footwear system that allows a wearer to easily customize the style and design of the base portions, upper portions, and connector elements to coordinate with the wearer's wardrobe; it provides a footwear system having decorative and functional connector elements that may be visible on the sides of the base portion when the footwear is worn; and it provides a footwear system that can be used with a variety of footwear, such as sandals, thongs, slides, slippers, mules, clogs, stilettos, and other footwear.

In one embodiment, the footwear system of the present invention comprises: an interchangeable base portion having a general shape to fit a human foot, wherein the base portion has a top surface, a bottom surface, opposed sidewalls extending between and connecting the top and bottom surfaces, and a plurality of spaced openings formed in each of the sidewalls, where each opening has an adjacent hollow receptacle embedded in the base portion; an interchangeable upper portion adapted for removable attachment to the base portion, the upper portion having opposed first and second side ends where each side end has a plurality of spaced openings, such that when the first and second side ends are coupled to the sidewalls of the base portion, the plurality of side end openings are aligned with the plurality of sidewall openings; and, a plurality of interchangeable connector elements each having an inner coupling end, an outer end, a body, and a collar coupled to the body and near the outer end, wherein when the upper portion is removably attached to the base portion, the connector elements are inserted through the plurality of side end openings, inserted through the plurality of corresponding sidewall openings, and inserted through and connected to the corresponding hollow receptacles, so that only the outer ends of the connector elements are visible.

In another embodiment, the footwear system of the present invention comprises: an interchangeable base portion having a general shape to fit a human foot, wherein the base portion has a top surface, a bottom surface, opposed sidewalls extending between and connecting the top and bottom surfaces, and a plurality of spaced openings formed in each of the sidewalls, where each opening has an adjacent hollow receptacle embedded in the base portion; an interchangeable upper portion adapted for removable attachment to the base portion, the upper portion having an exterior side, an interior side, opposed first and second side ends where each side end has a plurality of spaced openings, and wherein each side end opening has an adjacent female connector element positioned on the interior side of the upper portion; and, a plurality of interchangeable male connector elements each having an inner end, an outer end, a body, and a projection member coupled to the body and near the inner end, such that when the male connector element is inserted into the corresponding female connector element, the projection member releasably attaches the male connector element to the female connector element, and wherein when the upper portion is removably attached to the base portion, the attached male and female connector elements are inserted through the plurality of sidewall openings and are inserted through and coupled to the corresponding hollow receptacles, so that only the outer ends of the male connector elements are visible.

In yet another embodiment, the footwear system of the present invention comprises: an interchangeable base portion having a general shape to fit a human foot, wherein the base portion has a bottom surface, a top surface with a top opening and an adjacent recessed top hollow receptacle embedded in the base portion, opposed sidewalls extending between and connecting the top and bottom surfaces, and a plurality of spaced openings formed in each of the sidewalls, where each opening has an adjacent hollow sidewall receptacle embedded in the base portion; an interchangeable upper portion adapted for removable attachment to the base portion, the upper portion having a toe separating element and first and second strap elements each extending longitudinally from the toe separating element, wherein the first and second strap elements each have a first side end and each have a plurality of spaced openings in the first side end, such that when the upper portion is coupled to the base portion, a portion of the toe separating element is removably coupled within the top receptacle and the plurality of side end openings are aligned with the plurality of sidewall openings; and, a plurality of interchangeable connector elements each having an inner coupling end, an outer end, a body, and a collar coupled to the body and near the outer end, wherein when the upper portion is removably attached to the base portion, the connector elements are inserted through the plurality of side end openings, inserted through the plurality of corresponding sidewall openings, and inserted through and connected to the corresponding hollow sidewall receptacles, so that only the outer ends of the connector elements are visible.

In yet another embodiment, the footwear system of the present invention comprises: an interchangeable base portion having a general shape to fit a human foot, wherein the base portion has a bottom surface, a top surface with a top opening and an adjacent recessed top hollow receptacle embedded in the base portion, opposed sidewalls extending between and connecting the top and bottom surfaces, and a plurality of spaced openings formed in each of the sidewalls, where each opening has an adjacent hollow sidewall receptacle embedded in the base portion; an interchangeable upper portion adapted for removable attachment to the base portion, the upper portion having a toe separating element and first and second strap elements each extending longitudinally from the toe separating element, wherein the first and second strap elements each have an exterior side, an interior side, a first side end having a plurality of spaced openings in the first side end, and a female connector element adjacent each of the side end openings and positioned on the interior side of each of the strap elements; and, a plurality of interchangeable male connector elements each having an inner end, an outer end, a body, and a projection member coupled to the body and near the inner end, such that when the male connector element is inserted into the corresponding female connector element, the projection member releasably attaches the male connector element to the female connector element, and wherein when the upper portion is removably attached to the base portion, a portion of the toe separating element is removably coupled within the top receptacle, and the attached male and female connector elements are inserted through the plurality of sidewall openings and are inserted through and coupled to the corresponding sidewall hollow receptacles, so that only the outer ends of the male connector elements are visible.

In yet another embodiment, the footwear system of the present invention comprises: an interchangeable base portion having a general shape to fit a human foot, wherein the base portion has a bottom surface, a top surface with a top opening and an adjacent recessed top hollow receptacle embedded in the base portion, opposed sidewalls extending between and connecting the top and bottom surfaces, and a plurality of spaced openings formed in each of the sidewalls, where each opening has an adjacent hollow sidewall receptacle embedded in the base portion; an interchangeable upper portion adapted for removable attachment to the base portion, the upper portion having a toe separating element and first and second strap elements each extending longitudinally from the toe separating element, wherein the first and second strap elements each have an exterior side, an interior side, and a first side end; and, a plurality of male connector element attached to the interior side of the first side end of each of the strap elements, wherein each of the male connector elements has an inner coupling end, an outer end, a body, and a collar coupled to the body near the outer end, such that when the upper portion is removably attached to the base portion, a portion of the toe separating element is removably coupled within the top receptacle, and the male connector elements are inserted through the plurality of sidewall openings and are inserted through and coupled to the corresponding hollow sidewall receptacles.

These and other features and advantages of the present invention will become better understood from the following description and appended claims and accompanying drawings.

BRIEF DESCRIPTION OF THE DRAWINGS

Exemplary embodiments or versions of the present invention are shown in the drawings, in which:

FIG. 19 is a side perspective view of the first version of the removable upper portion of the thong footwear showing the first version of the connector elements and a stacked heel base portion;

FIG. 20 is a side perspective view of the first version of the removable upper portion of the thong footwear showing the first version of the connector elements and a flat heel base portion;

FIG. 21 is a side perspective view of the footwear of FIG. 15A where the connector elements have decorative ends;

FIG. 22 is the cross-sectional view taken along lines 22-22 of FIG. 21;

FIG. 23 is a cut-away enlarged side view of the base portion of the footwear system of the present invention;

FIG. 24 is a side perspective view of the slide footwear having another version of the footwear system of the present invention showing male and female connector elements and receptacles in the base portion;

FIG. 40 is an enlarged perspective view of a fifth version of the attachment means for the toe separating element of the thong footwear of the present invention where the toe separating element is detached from the base portion of the thong footwear;

FIG. 41 is the toe separating element of FIG. 40 shown after it is secured into the base portion of the thong footwear via a snap attachment element; and, FIG. 42 is a side perspective view of the thong footwear with a third version of the connector elements connection means and a wedge heel base portion.

DETAILED DESCRIPTION OF THE INVENTION

The present invention is directed to a novel and nonobvious footwear system with interchangeable portions. The footwear system of the present invention allows a wearer to customize the wearer's footwear with easily interchangeable portions, such as a plurality of base portions, upper portions, and connector elements in a variety of styles, colors and designs to provide an assortment of footwear in a single system.

Figure 15A:
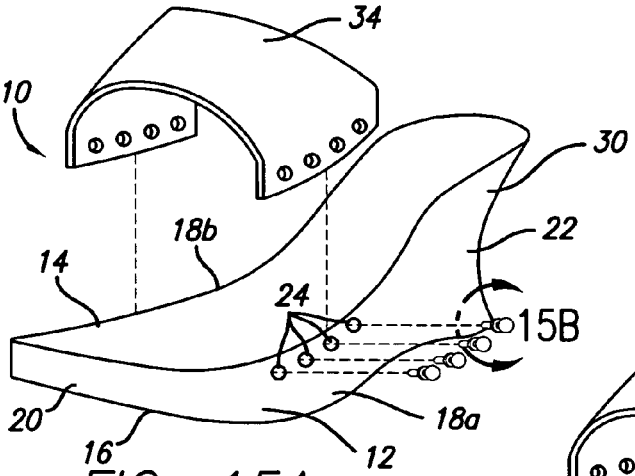
FIG. 15A is a side perspective view of the first version of the removable upper portion of the slide footwear with a first version of the connector elements and a wedge heel base portion.
Figure 15B:
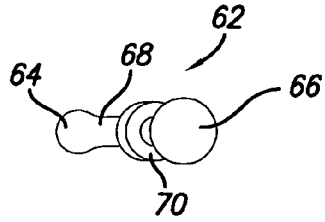
FIG. 15B is an enlarged view of circle 15B of FIG. 15A showing the first version of the connector elements.
Figure 16:
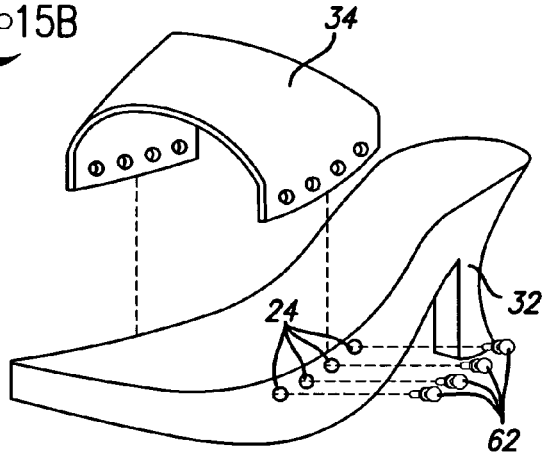
FIG. 16 is a side perspective view of the first version of the removable upper portion of the slide footwear showing the first version of the connector elements and a stacked heel base portion.
Figure 17:
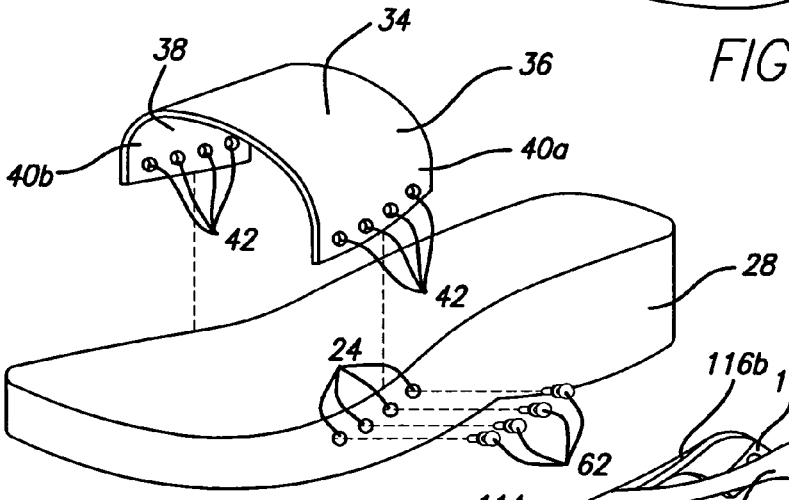
FIG. 17 is a side perspective view of the first version of the removable upper portion of the slide footwear showing the first version of the connector elements and a flat heel base portion.

With reference now to the drawings, a first embodiment of the footwear system of the present invention is shown in FIGS. 15-17 for slide sandals. FIG. 15A shows footwear system 10 comprised of a plurality of components. Footwear system 10 comprises an interchangeable base portion 12 having a general shape to fit a human foot and being in a generally oblong configuration. The base portion 12 has a top surface 14, a bottom surface 16, and a first sidewall 18*a* and a second sidewall 18*b*, where the sidewalls 18*a*, 18*b* are opposed to each other and extend between the top and bottom surfaces and connect the top and bottom surfaces. The base portion 12 further has a toe portion 20 and a heel portion 22. The base portion 12 further has a plurality of spaced openings 24 formed in a portion or portions of each of the opposed sidewalls 18*a*, 18*b*. Each sidewall opening 24 has an adjacent hollow sidewall receptacle 26 (see FIG. 23) embedded in the base portion 12. The base portion 12 is of a suitable thickness to adequately house the receptacles embedded in the sidewalls of the base portion. The base portion 12 may have the heel portion 22 in the form of a flat or substantially flat heel 28 as shown in FIG. 17. Alternatively, the base portion 12 may have the heel portion 22 in the form of a wedge heel 30 as shown in FIG. 15A, or the base portion 12 may have the heel portion 22 in the form of a stacked heel 32 as shown in FIG. 16. Other suitable heel configurations such as low heels, high heels, kitten heels, stiletto heels, and other type heels may also be used with the footwear system of the present invention. The base portion 12 may be of a molded construction and made of any suitable durable and resilient material, such as rubber, rubber composition, plastic or resinous material, wood, elastomeric material, leather, or another suitable material. It will be understood that instead of being formed of separate layers, the base portion may be formed from a single thickness of rubber, plastic, leather or other suitable material split edgewise inwardly where the receptacles are housed. The base portion may be made in a variety of heel styles, colors and designs to coordinate with the other interchangeable components of the footwear.

As particularly shown in FIG. 17, as well as FIGS. 15A and 16, the footwear system of the present invention further comprises an interchangeable upper portion 34 adapted for removable attachment to the base portion 12. The upper portion 34 is designed to retain the foot of a user within the footwear when in use. The upper portion 34 has an exterior side 36, an interior side 38, and opposed first side end 40*a* and second side end 40*b*. Each of the first and second side ends 40*a*, 40*b* has a plurality of spaced openings 42 formed along a portion or portions of each of the first and second side ends. When the first and second side ends 40*a*, 40*b* are coupled to the sidewalls 18*a*, 18*b* of the base portion 12, each of the plurality of side end openings 42 are preferably aligned with each of the plurality of corresponding sidewall openings 24. Preferably, the number of spaced openings 42 on each first and second side end is the same as, and corresponds to, the number of spaced openings 24 on each sidewall. The upper portion 34 may be made of rubber, plastic, leather, fabric, satin, canvas, neoprene, cloth, elastomeric material, or another suitable material that may be chosen based on functionality and/or decorativeness. The upper portion may include ornamentation, surface patterns, color arrangements, and other design elements, for coordination with the wearer's apparel.

Figure 1:
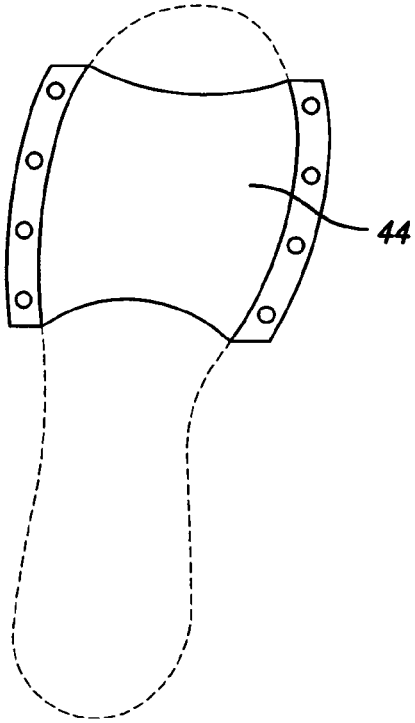
FIG. 1 is a top view of a first version of a removable upper portion of a slide footwear of the present invention.
Figure 2:
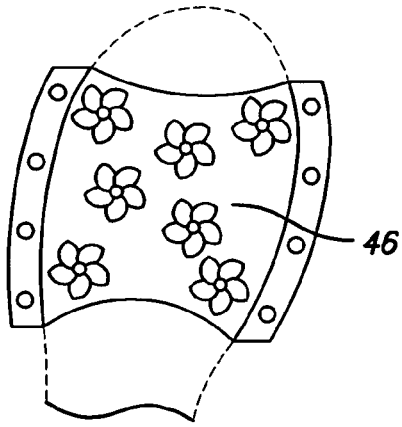
FIG. 2 is a top partial view of a second version of a removable upper portion of a slide footwear of the present invention.
Figure 3:
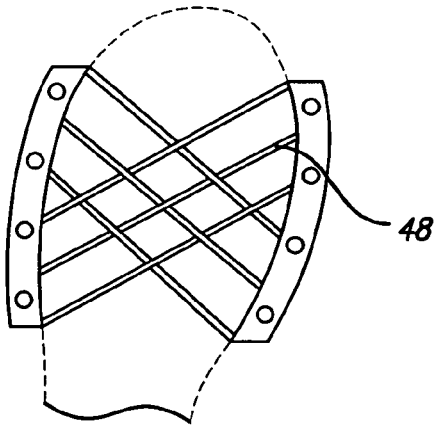
FIG. 3 is a top partial view of a third version of a removable upper portion of a slide footwear of the present invention.
Figure 4:
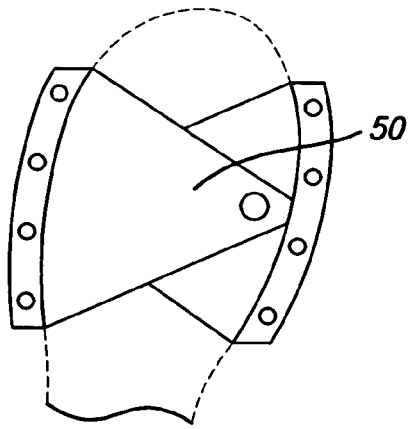
FIG. 4 is a top partial view of a fourth version of a removable upper portion of a slide footwear of the present invention.
Figure 5:
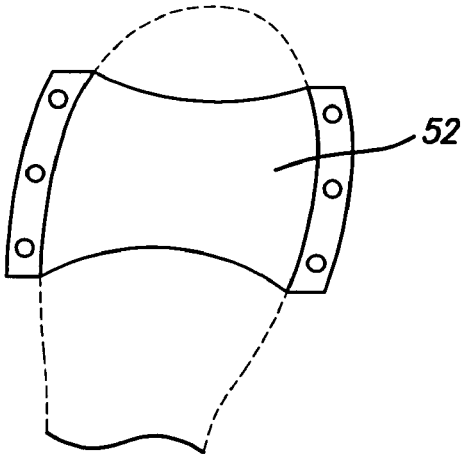
FIG. 5 is a top partial view of a fifth version of a removable upper portion of a slide footwear of the present invention.
Figure 6:
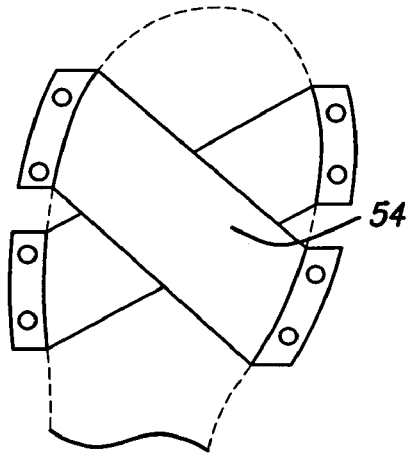
FIG. 6 is a top partial view of a sixth version of a removable upper portion of a slide footwear of the present invention.
Figure 7:
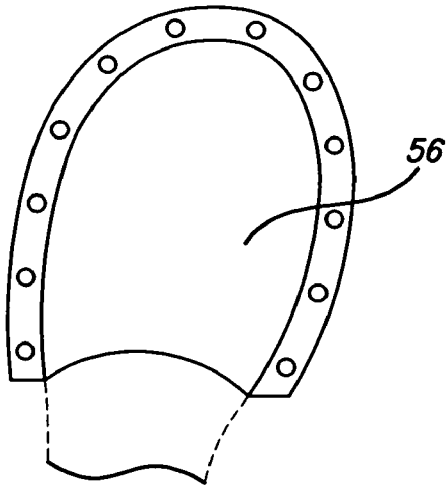
FIG. 7 is a top partial view of a seventh version of a removable upper portion of a slide footwear of the present invention.
Figure 8:
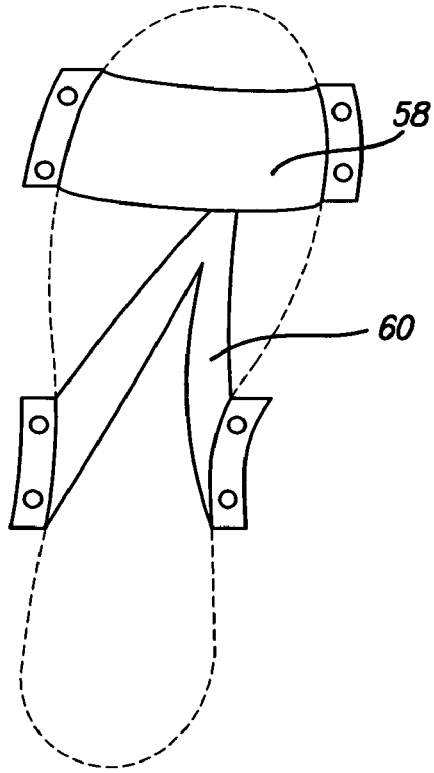
FIG. 8 is a top partial view of an eighth version of a removable upper portion of a slide footwear of the present invention.

The upper portion 34 may be comprised of a single strap element, a plurality of strap elements, or other various configurations. The straps may be adjustable and/or arranged in a variety of configurations, such as criss-cross, parallel, or other patterns. For example, FIG. 1 is a top view of a first version of a removable upper portion of a slide footwear where the upper portion is a wide single strap element 44. FIG. 2 is a top partial view of a second version of a removable upper portion of a slide footwear where the upper portion is a decorated wide single strap element 46. FIG. 3 is a top partial view of a third version of a removable upper portion of a slide footwear where the upper portion is a plurality of cross strap elements 48. FIG. 4 is a top partial view of a fourth version of a removable upper portion of a slide footwear where the upper portion is a cross flap element 50. FIG. 5 is a top partial view of a fifth version of a removable upper portion of a slide footwear where the upper portion is a narrow single strap element 52. FIG. 6 is a top partial view of a sixth version of a removable upper portion of a slide footwear where the upper portion is a double cross strap element 54. FIG. 7 is a top partial view of a seventh version of a removable upper portion of a slide footwear where the upper portion is a slipper element 56. FIG. 8 is a top partial view of an eighth version of a removable upper portion of a slide footwear where the upper portion is single top strap element 58 having a plurality of elongated strap elements 60 coupled to the top strap element 58.

As shown in FIG. 15B, the footwear system of the present invention may further comprise a first version of a plurality of interchangeable connector elements 62. Each connector element 62 is preferably a unitary piece having an inner coupling end 64, an outer end 66, a body 68, and a collar 70 coupled to the body and located near the outer end 66. However, the connector element may also be comprised of separate pieces. For example, the outer end may be removably attached to the body via attachment means, such as a threaded screws, snaps or other attachment means, and the outer end may be removed and replaced with decorative outer end elements, such decorative elements as further discussed below. Preferably, the connector elements 62 may be fabricated of metal, rubber, plastic, or another suitable material. In use, as shown in FIG. 15A, when the upper portion 34 is removably attached to the base portion 12, the upper portion 34 is preferably placed over and adjacent an upper portion of the sidewalls of the base portion 12, so that each of the plurality of side end openings 42 are aligned with each of the plurality of corresponding sidewall openings 24. The connector elements 62 are then inserted through the plurality of corresponding side end openings 42, are inserted through the plurality of corresponding sidewall openings 24, and are inserted through and connected to the plurality of corresponding hollow sidewall receptacles 26, so that only the outer ends 66 of the connector elements 62 are visible. Each of the hollow sidewall receptacles 26 adjacent each respective sidewall opening 24 is embedded in the base portion 12. The body 68 of each of the connector elements 62 is of a configuration that substantially conforms to the interior of the hollow sidewall receptacles 26, so that when the body 68 of the connector element 62 is connected and coupled within the sidewall receptacle 26, the connector element is securely connected to prevent or minimize disengagement of the connector element from the receptacle and, in turn, prevent or minimize disengagement of the upper portion from the base portion. As shown in FIG. 22, which is a cross-sectional view taken along lines 22-22 of FIG. 21, the connector element 62 is shown in cross section connected to and within the receptacle 26. The inner end 64 has a slightly bulged configuration that forms a lip portion 72 around the circumference of the body 68. The lip portion 72 acts to snap and secure the connector element 62 to an interior end portion 74 of the receptacle that has a configuration adapted to receive and attach the inner end 64 of the connector element 62. The collar 70 that acts as a barrier wall is inserted through the side end opening 42 and the sidewall opening 24 when the upper portion is attached to the base portion. The collar 70 acts as further securement of the connector element 62 within the receptacle 26. As shown in FIG. 22, the collar 70 fits securely through the side end opening of the upper portion and through the sidewall opening of the base portion, so that the connector element cannot be easily disengaged from the receptacle when the footwear system is in use. FIG. 23 is a cut-away enlarged side view of the base portion of the footwear system. The sidewall opening 24 is adjacent the hollow sidewall receptacle 26. Edge portion 76 of the receptacle is of the same or substantially the same width and dimension as the width and dimension of collar 70, and when the collar 70 is inserted into the receptacle, the collar is housed securely against the edge portion. The edge portion and receptacle house the collar and body of the connector element and allow the upper portion to be positioned flush against the sidewall of the base portion.

As shown in FIG. 21, the footwear system may further include decorative elements 78, or charm connectors, fixed or coupled to one or more of the outer ends 66 of the connector elements 62. The decorative elements 78 may be removably attached to the outer ends of the connector elements with adhesive, glue, snaps, threaded screw means, or another suitable connection means. Alternatively, the outer ends of the connector elements as shown in FIG. 15B may be replaced with decorative elements, such as shown in FIG. 21, and the connector elements may be of a unitary construction with decorative elements on the ends of the connector elements. In this version, such decorative elements may be welded onto the ends of the connector elements or permanently attached by another attachment means. The decorative elements may be in the form of stars, hearts, letters, numbers, or any number of decorative shapes, colors or designs. Preferably, the decorative elements 78 may be fabricated of metal, rubber, plastic, or another suitable material.

Figure 25:
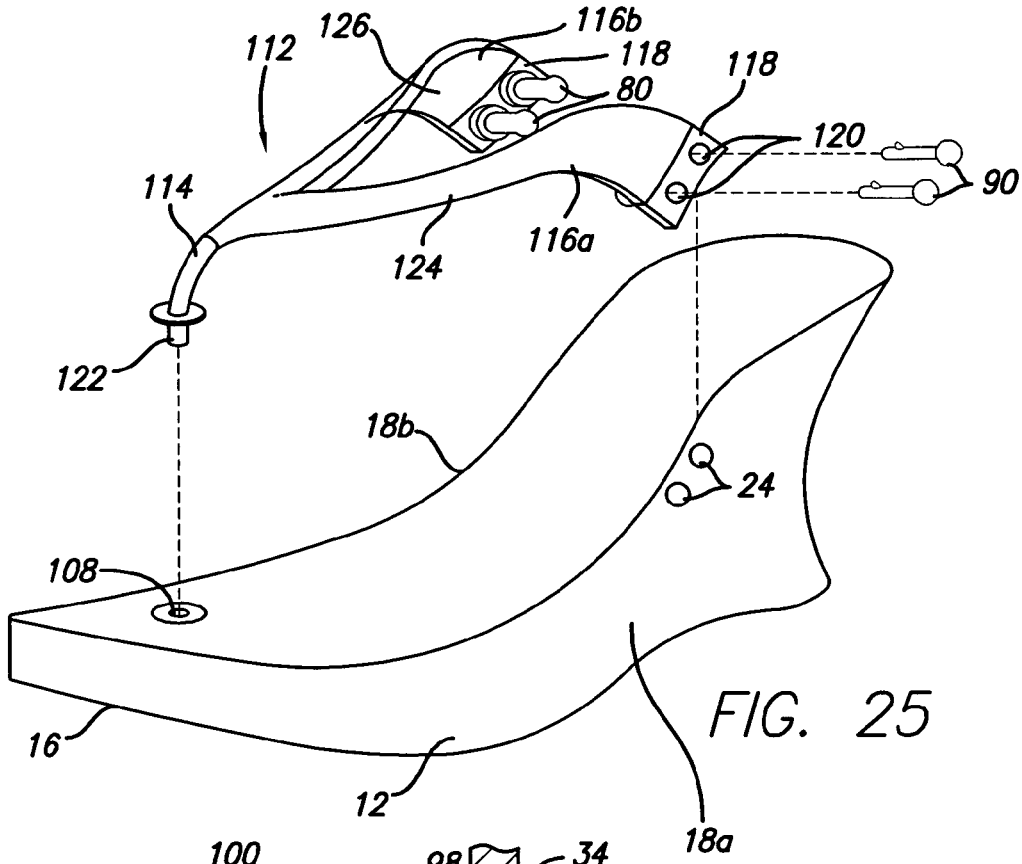
FIG. 25 is a side perspective view of the thong footwear having another version of the footwear system of the present invention showing male and female connector elements and receptacles in the base portion.
Figure 26:
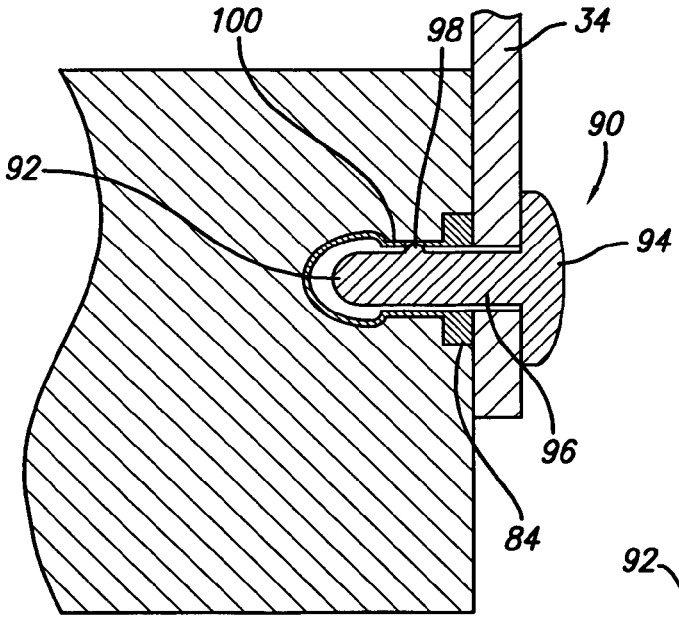
FIG. 26 is fragmentary exploded cross sectional view of the male and female connector elements of FIGS. 24 and 25.
Figure 27:
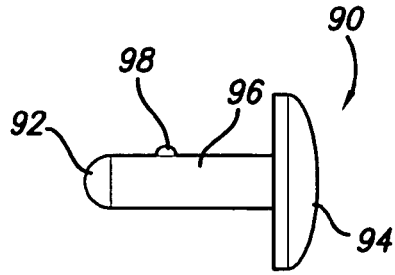
FIG. 27 is an enlarged side view of the male connector element of FIGS. 24 and 25.

A second embodiment of the footwear system of the present invention is shown in FIGS. 24-27. FIG. 24 is a side perspective view of this version for slide footwear showing male and female connector elements and receptacles in the base portion, as discussed below. FIG. 25 is a side perspective view of this version for thong footwear showing male and female connector elements and receptacles in the base portion. FIG. 26 is fragmentary exploded cross-sectional view of the male and female connector elements of FIGS. 24 and 25. FIG. 27 is an enlarged side view of the male connector element of FIGS. 24 and 25. In the slide embodiment as shown in FIG. 24, the footwear system 10 comprises interchangeable base portion 12 having a general shape to fit a human foot, the base portion having top surface 14, bottom surface 16, and opposed sidewalls 18*a*, 18*b* extending between and connecting the top and bottom surfaces. The base portion further comprises the plurality of spaced sidewall openings 24 formed in each of the sidewalls, where each sidewall opening has the adjacent hollow receptacle 26 (see FIG. 23) embedded in the base portion. The footwear system 10 further comprises the interchangeable upper portion 34 adapted for removable attachment to the base portion. The upper portion has exterior side 36, interior side 38, and opposed first and second side ends 40*a*, 40*b*, where each side end has a plurality of spaced openings 42. Unique to this second embodiment is that each side end opening 42 has an adjacent female connector element 80 positioned on the interior side 38 of the upper portion 34. The female connector element 80 comprises a first end 82 having a collar 84 coupled to the first end 82, a hollow body 86, and a second end 88. The second embodiment further comprises a plurality of interchangeable male connector elements 90. FIG. 27 is an enlarged side view of the male connector element 90. The male connector element has an inner end 92, an outer end 94, a body 96, and a projection member 98 coupled to the body 96 near the inner end 92. As shown in FIG. 26, when the male connector element 90 is inserted into the corresponding female connector element 80, the projection member 98 releasably attaches the male connector element 90 to the female connector element 80 via a lip portion 100 positioned within the hollow body 86 of the female connector element 80. The hollow body 86 of the female connector element 80 is adapted to receive and secure the male connector element 90. When the upper portion is removably attached to the base portion in this second embodiment, the attached male and female connector elements 90, 80, respectively, are inserted through the plurality of sidewall openings 24 and are inserted through and coupled to the corresponding hollow sidewall receptacles 26, so that only the outer ends 94 of the male connector elements 90 are visible. FIG. 26 is a fragmentary exploded cross-sectional view of the male and female connector elements connecting the upper portion to the base portion. The second end 88 of the female connector element 80 has a slightly bulged configuration with lip portion 100 around the circumference of the body 86. The projection member 98 snaps and secures the male connector element 90 via the lip portion 100 within the female connector element 90. The collar 84 acts as further securement of the male and female connector elements within the receptacle 26.

The male connector element is preferably fabricated of a suitable metal or plastic which provides substantial rigidity. The female connector element may also be fabricated of a suitable metal or plastic, or injection-molded into the upper portion. It is also contemplated that a magnetic attraction may exist between the male connector element and the female connector element. In this case, each of the male and female connector elements are made of a magnetic or ferro-magnetic material, such as metal or plastic impregnated with a ferro-magnetic material.

In each of the embodiments of the footwear system of the present invention, the shape of the upper portion openings and sidewall openings is the same, so that the upper portion may be interchangeable with any number of base portions, and the base portion may be interchangeable with any number of upper portions within the corresponding style. As discussed above, in the first preferred embodiment, the connector element is inserted through the opening in the upper portion and is inserted through the opening and receptacle in the base portion. In the second preferred embodiment, the male connector element is inserted into and attached to the female connector element, and the attached male and female connectors are inserted through the opening and receptacle in the base portion.

Figure 18:
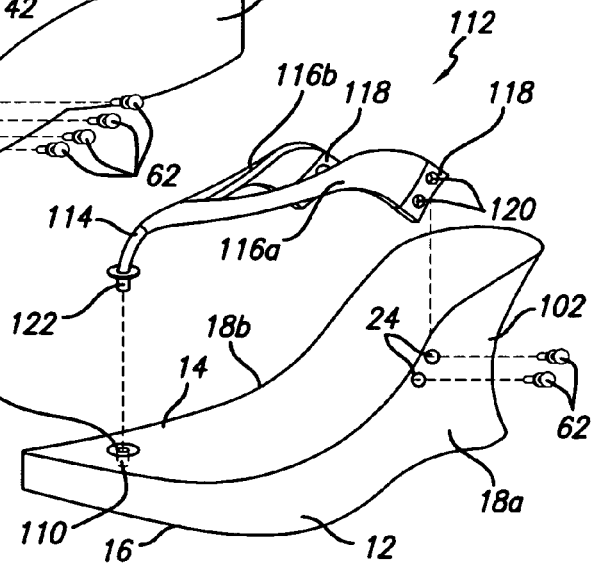
FIG. 18 is a side perspective view of the first version of the removable upper portion of the thong footwear showing the first version of the connector elements and a wedge heel base portion.

Another embodiment of the footwear system of the present invention is shown in FIGS. 18-20 for thongs. FIG. 18 is a side perspective view of the thong footwear showing the first version of the connector elements and a wedge heel base portion 102. FIG. 19 is a side perspective view of the thong footwear showing the first version of the connector elements and a stacked heel base portion 104. FIG. 20 is a side perspective view of the thong footwear showing the first version of the connector elements and a flat heel base portion 106. As shown in FIG. 18, the footwear system 10 comprises the interchangeable base portion 12 having a general shape to fit a human foot, the base portion 12 having the top surface 14, bottom surface 16, and opposed sidewalls 18*a*, 18*b* extending between and connecting the top and bottom surfaces. The base portion 12 has the plurality of spaced openings 24 formed in each of the sidewalls, where each opening has an adjacent hollow sidewall receptacle 26 embedded in the base portion. In this thong version, the top surface 14 further includes a top opening 108 and an adjacent recessed top hollow receptacle 110 embedded in the base portion. The thong version further comprises an interchangeable upper portion 112 adapted for removable attachment to the base portion 12. The upper portion 112 has a toe separating element 114 and first and second strap elements 116*a*, 116*b*, each extending longitudinally from the toe separating element 114. Each of the first and second strap elements 116*a*, 116*b* have a first side end 118. Each side end 118 has a plurality of spaced side end openings 120 formed in the first side end 118. When the upper portion 112 is coupled to the base portion 12, a portion 122 of the toe separating element 114 is removably coupled within the top receptacle 110 and the plurality of side end openings 120 are aligned with the plurality of sidewall openings 24. The thong version further comprises a first version of connector elements as shown in FIG. 15B. The plurality of interchangeable connector elements 62 each have an inner coupling end 64, an outer end 66, a body 68, and a collar 70 coupled to the body and near the outer end. When the upper portion is removably attached to the base portion, the connector elements 62 are inserted through the plurality of side end openings 120, inserted through the plurality of corresponding sidewall openings 24, and inserted through and connected to the corresponding hollow sidewall receptacles 26, so that only the outer ends 66 of the connector elements 62 are visible.

In another embodiment of the thong version, the connector elements are as shown in FIG. 24-27. The footwear system using this connector element system for a thong is shown in FIG. 25. The footwear system of this thong version comprises the base portion 12 having the top surface 14, the bottom surface 16 with the top opening 108 and adjacent recessed top hollow receptacle 110 embedded in the base portion, opposed sidewalls 18*a*, 18*b* extending between and connecting the top and bottom surfaces, and a plurality of spaced openings 24 formed in each of the sidewalls, where each opening has an adjacent hollow sidewall receptacle 26 embedded in the base portion. The footwear system further comprises the interchangeable upper portion 112 having the toe separating element 114 and first and second strap elements 116*a*, 116*b* each extending longitudinally from the toe separating element 114 toward the heel portion, wherein the first and second strap elements each have an exterior side 124, an interior side 126, a first side end 118 having a plurality of spaced openings 120 in the first side end, and a female connector element 80 adjacent each of the side end openings and positioned on the interior side 126 of each of the strap elements 116*a*, 116*b*. The footwear system further comprises a plurality of interchangeable male connector elements 90 each having an inner end 92, an outer end 94, a body 96, and a projection member 98 coupled to the body near the inner end, such that when the male connector element 90 is inserted into the corresponding female connector element 80, the projection member 98 releasably attaches the male connector element 90 to the female connector element 80. When the upper portion is removably attached to the base portion, a portion 122 of the toe separating element 114 is removably coupled within the top receptacle 110, and the attached male and female connector elements 90, 80, respectively, are inserted through the plurality of sidewall openings and are inserted through and coupled to the corresponding sidewall hollow receptacles, so that only the outer ends of the male connector elements are visible.

Figure 9:
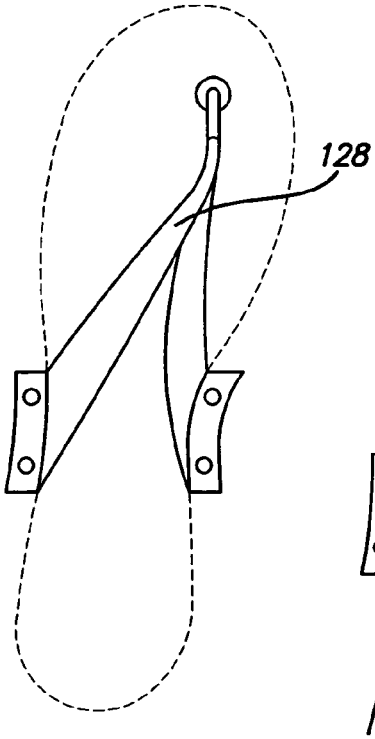
FIG. 9 is a top view of a first version of a removable upper portion of a thong footwear of the present invention.
Figure 10:
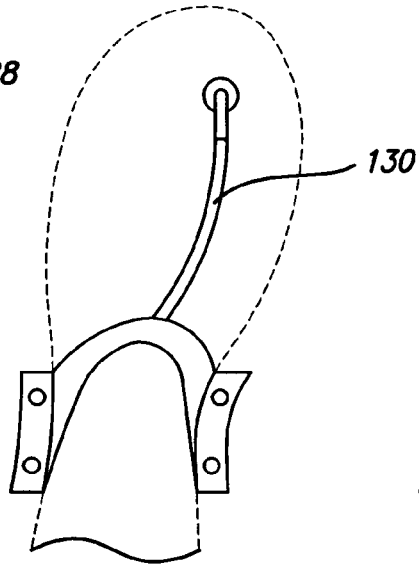
FIG. 10 is a top partial view of a second version of a removable upper portion of a thong footwear of the present invention.
Figure 11:
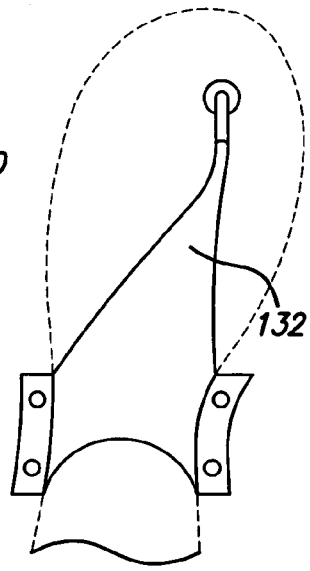
FIG. 11 is a top partial view of a third version of a removable upper portion of a thong footwear of the present invention.
Figure 12:
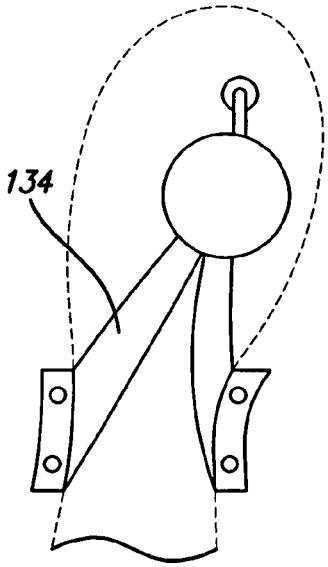
FIG. 12 is a top partial view of a fourth version of a removable upper portion of a thong footwear of the present invention.
Figure 13:
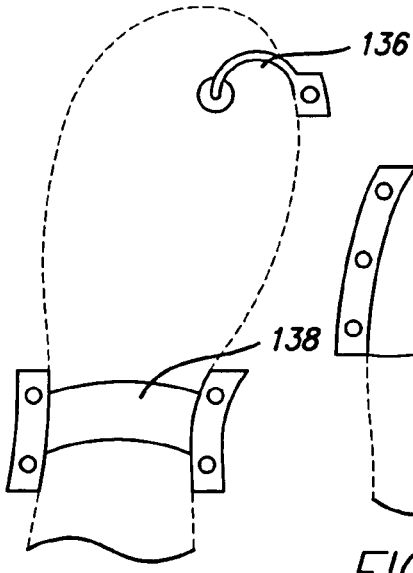
FIG. 13 is a top partial view of a fifth version of a removable upper portion of a thong footwear of the present invention.
Figure 14:
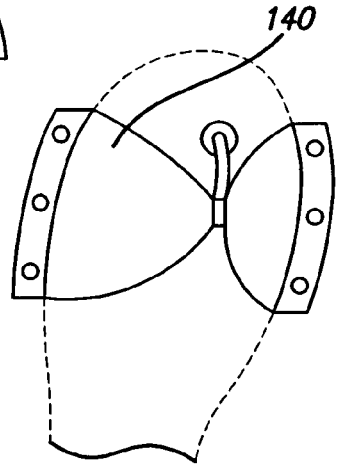
FIG. 14 is a top partial view of a sixth version of a removable upper portion of a thong footwear of the present invention.

The upper portion of the thong version may have numerous designs and styles as shown in FIGS. 9-14. FIG. 9 is a top view of a first version of a first removable upper portion 128 of the thong footwear. FIG. 10 is a top partial view of a second version of a second removable upper portion 130 of the thong footwear. FIG. 11 is a top partial view of a third version of a third removable upper portion 132 of the thong footwear. FIG. 12 is a top partial view of a fourth version of a fourth removable upper portion 134 of the thong footwear. FIG. 13 is a top partial view of a fifth version of a fifth removable upper portion comprising first portion 136 and second portion 138 of the thong footwear. FIG. 14 is a top partial view of a sixth version of a sixth removable upper portion 140 of the thong footwear. The thong version may further include decorative elements 78, and the base portion may comprise a flat heel, wedge heel, stacked heel, or other desired heel.

Figure 28:
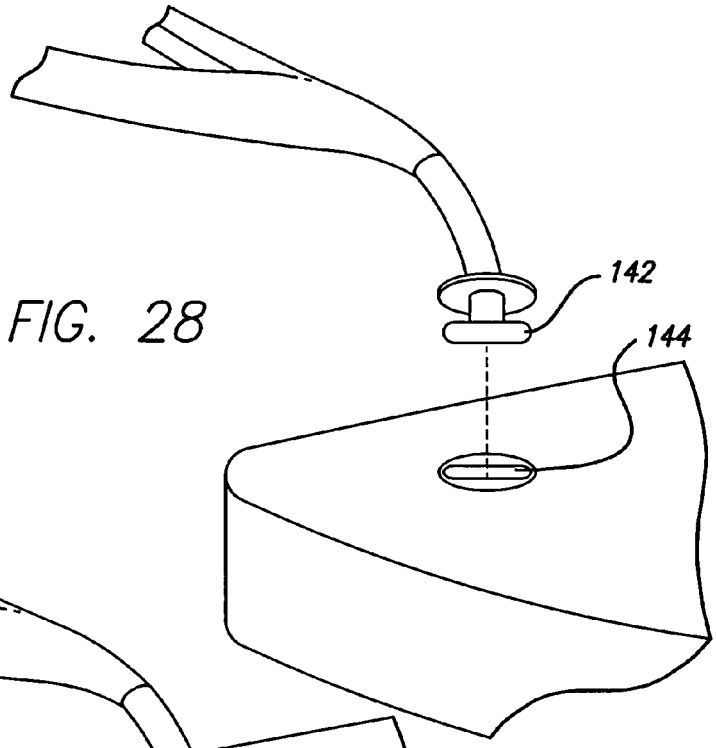
FIG. 28 is an enlarged perspective view of a first version of the attachment means for the toe separating element of the thong footwear of the present invention where the toe separating element is detached from the base portion of the thong footwear.
Figure 29:
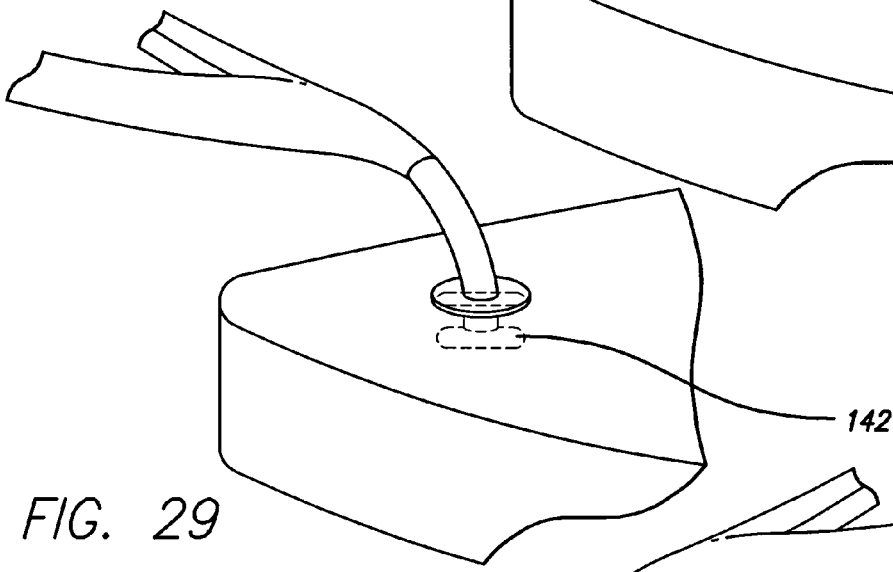
FIG. 29 is the toe separating element of FIG. 28 shown after it is inserted into the base portion of the thong footwear.
Figure 30:
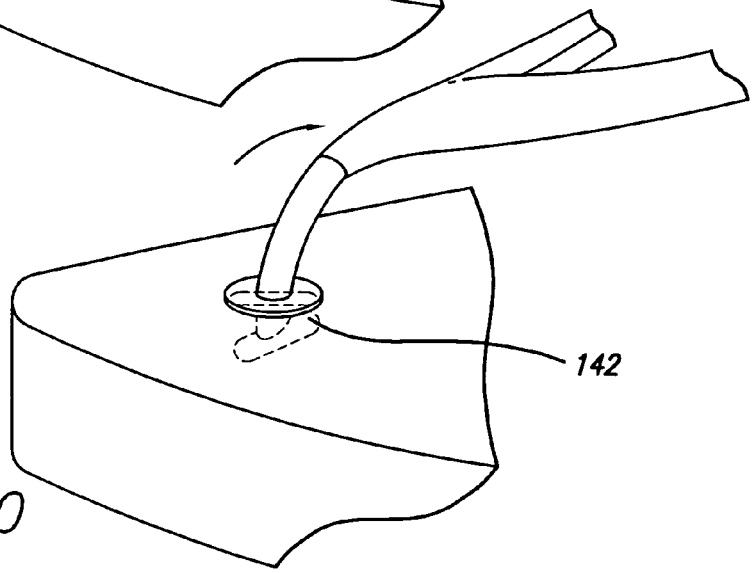
FIG. 30 is the toe separating element of FIG. 28 shown after it is twisted and secured into the base portion of the thong footwear via a turnlock attachment element.

In addition, the thong version may have various means of securely attaching the toe separating element 114 within the top receptacle 110, as shown in FIGS. 28-41. FIGS. 28-30 show a turnlock attachment element 142 and a turnlock receiving element 144. FIG. 28 is an enlarged perspective view of a first version of the attachment means where the toe separating element is detached from the base portion of the thong footwear. FIG. 29 is the toe separating element of FIG. 28 shown after the turnlock attachment 142 is inserted into the turnlock receiving element 144 formed in the base portion of the thong footwear. FIG. 30 is the toe separating element of FIG. 28 shown after the turnlock element is rotated 90 degrees in the turnlock receiving element to secure the toe separating element to the base portion.

Figure 31:
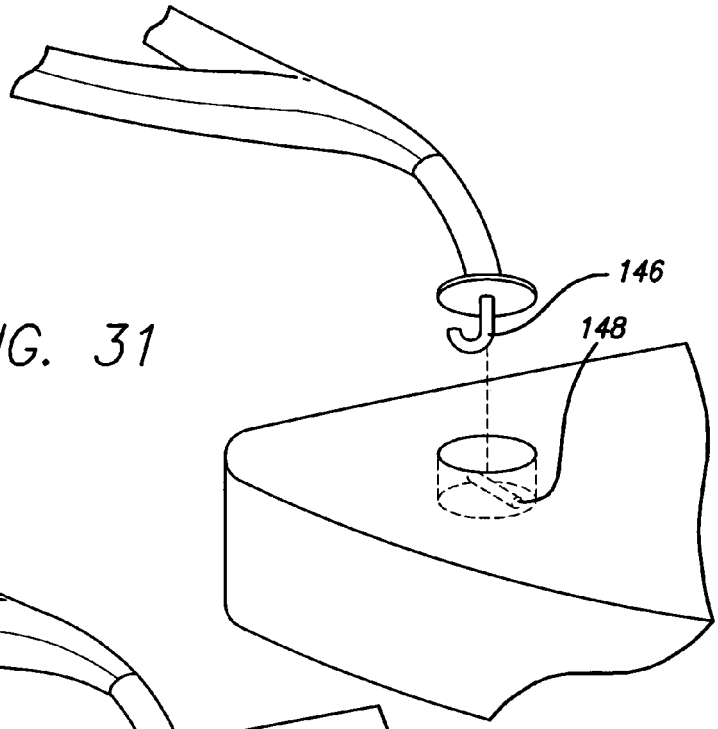
FIG. 31 is an enlarged perspective view of a second version of the attachment means for the toe separating element of the thong footwear of the present invention where the toe separating element is detached from the base portion of the thong footwear.
Figure 32:
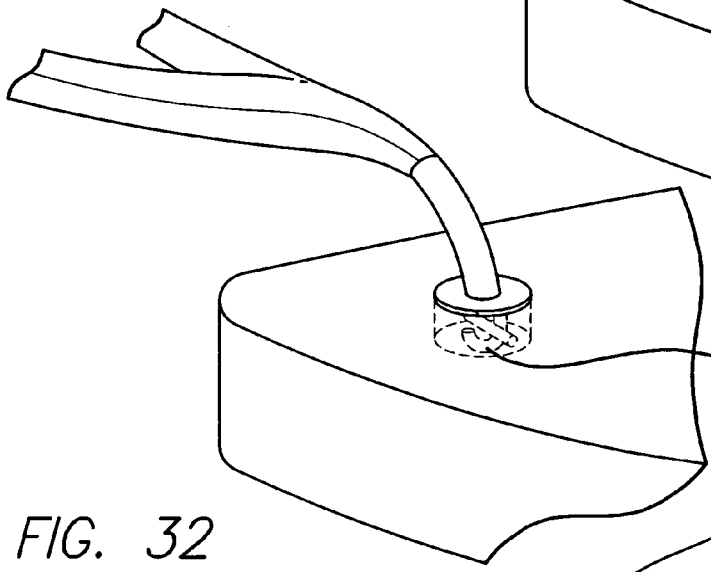
FIG. 32 is the toe separating element of FIG. 31 shown after it is inserted into the base portion of the thong footwear.
Figure 33:
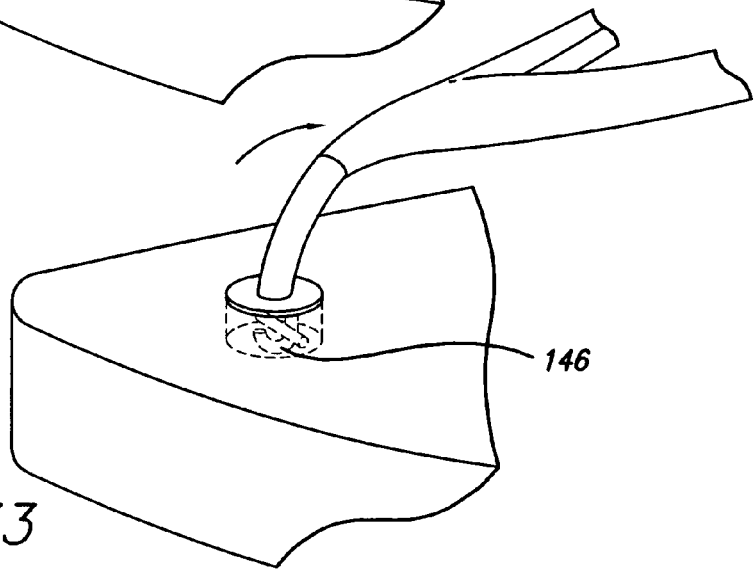
FIG. 33 is the toe separating element of FIG. 31 shown after it is secured into the base portion of the thong footwear via a hook attachment element.

FIGS. 31-33 show a hook attachment element 146 and a hook receiving element 148. FIG. 31 is an enlarged perspective view of a second version of the attachment means where the toe separating element is detached from the base portion of the thong footwear. FIG. 32 is the toe separating element of FIG. 31 shown after the hook attachment element 146 is inserted into the hook receiving element 148, such as a bar, formed in the base portion of the thong footwear. FIG. 33 is the toe separating element of FIG. 31 shown after the hook attachment element is hooked to the hook receiving element to secure the toe separating element to the base portion.

Figure 34:
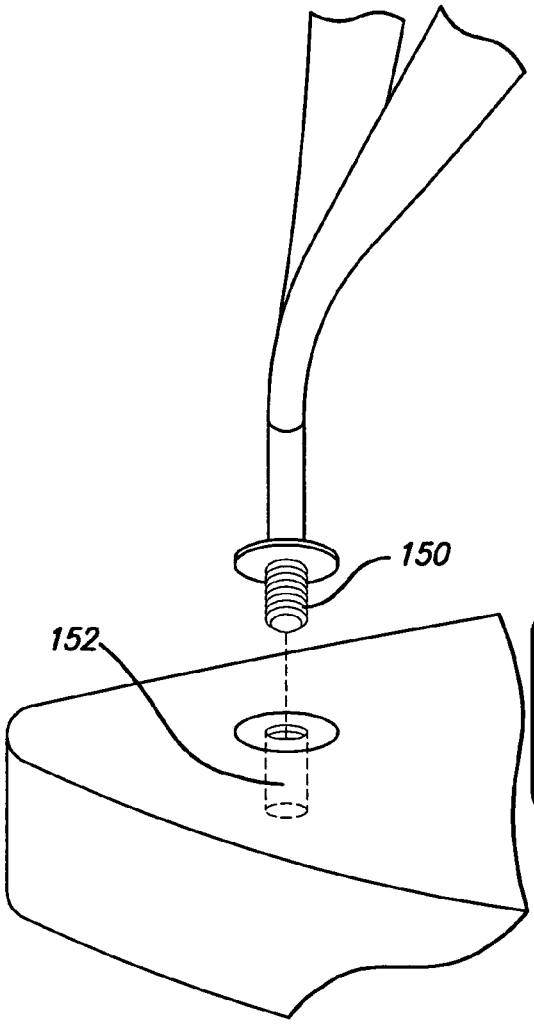
FIG. 34 is an enlarged perspective view of a third version of the attachment means for the toe separating element of the thong footwear of the present invention where the toe separating element is detached from the base portion of the thong footwear.
Figure 35:
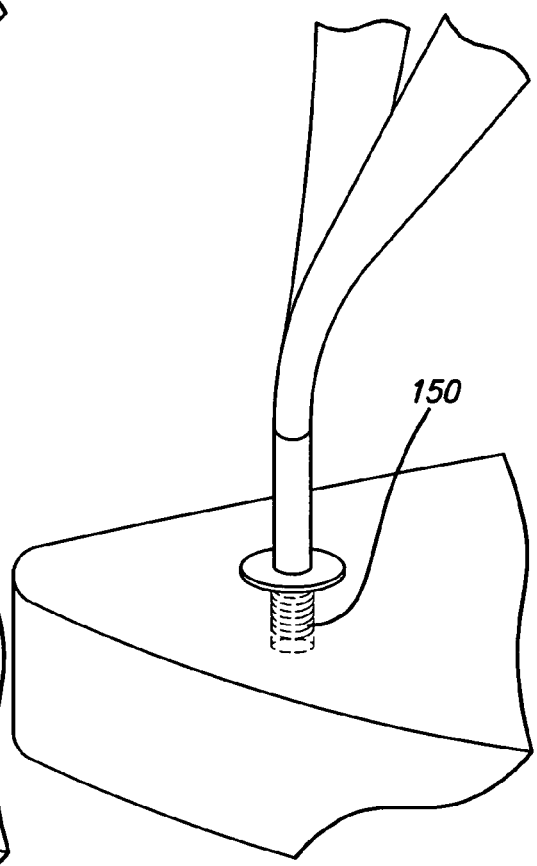
FIG. 35 is the toe separating element of FIG. 34 shown after it is inserted into the base portion of the thong footwear.
Figure 36:
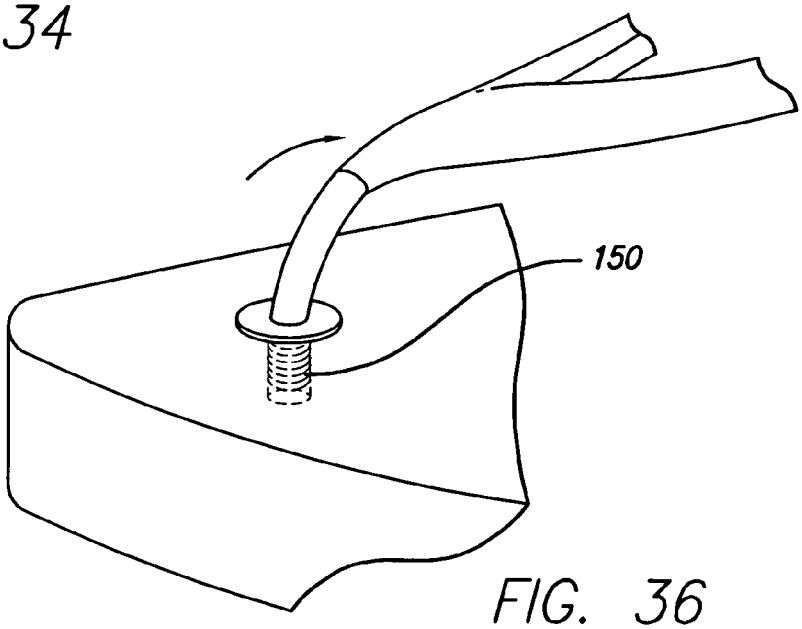
FIG. 36 is the toe separating element of FIG. 34 shown after it is secured into the base portion of the thong footwear via a threaded screw attachment element.

FIGS. 34-36 show a threaded screw attachment element 150 and a threaded screw receiving element 152. FIG. 34 is an enlarged perspective view of a third version of the attachment means where the toe separating element is detached from the base portion of the thong footwear. FIG. 35 is the toe separating element of FIG. 34 shown after the threaded screw attachment element 150 is inserted into the threaded screw receiving element 152 formed in the base portion of the thong footwear. FIG. 36 is the toe separating element of FIG. 34 shown after the threaded screw attachment is rotated at least 360 degrees into the threaded screw receiving element to secure the toe separating element to the base portion.

Figure 37:
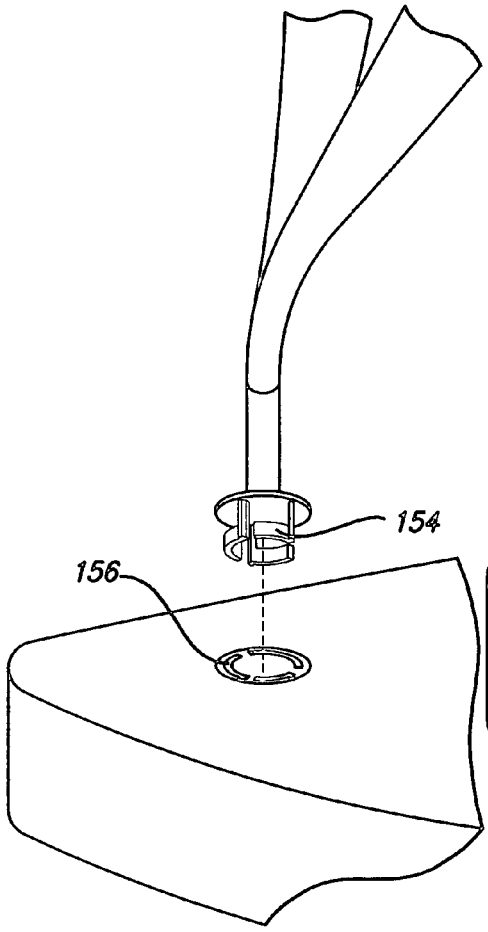
FIG. 37 is an enlarged perspective view of a fourth version of the attachment means for the toe separating element of the thong footwear of the present invention where the toe separating element is detached from the base portion the thong footwear.
Figure 38:
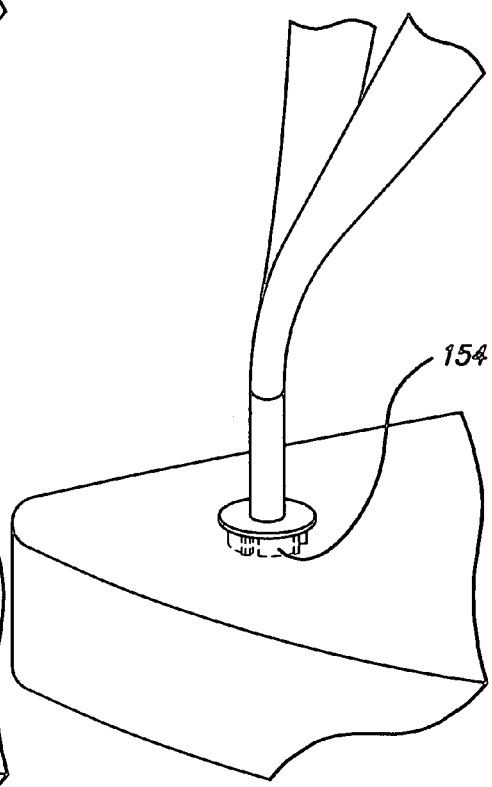
FIG. 38 is the toe separating element of FIG. 37 shown after it is inserted into the base portion of the thong footwear.
Figure 39:
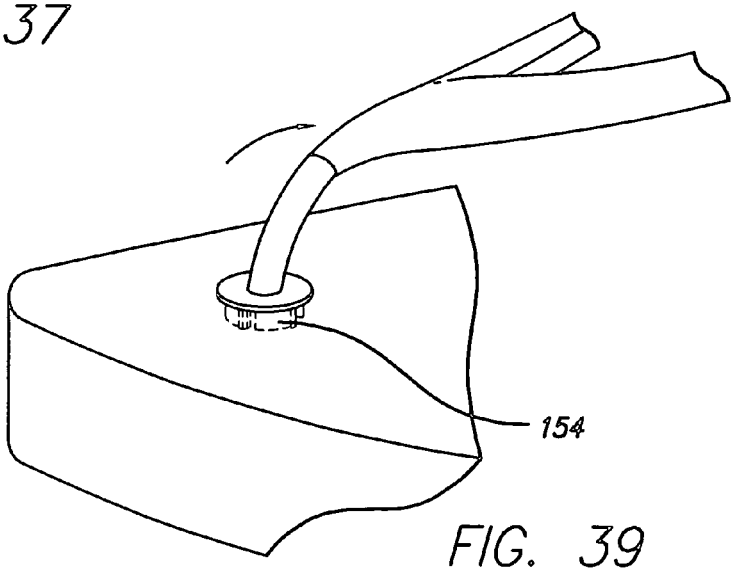
FIG. 39 is the toe separating element of FIG. 37 shown after it is secured into the base portion of the thong footwear via a prong attachment element.

FIGS. 37-39 show a prong attachment element 154 and prong receiving element 156. FIG. 37 is an enlarged perspective view of a fourth version of the attachment means where the toe separating element is detached from the base portion the thong footwear. FIG. 38 is the toe separating element of FIG. 37 shown after the prong attachment element 154 is inserted into the prong receiving element 156 formed in the base portion of the thong footwear. FIG. 39 is the toe separating element of FIG. 37 shown after the prong attachment element is rotated 45 degrees in the prong receiving element to secure the toe separating element to the base portion.

FIGS. 40-41 show a snap element 158 and a snap receiving element 160. FIG. 40 is an enlarged perspective view of a fifth version of the attachment means where the toe separating element is detached from the base portion of the thong footwear. FIG. 41 is the toe separating element of FIG. 40 shown after the snap element 158 is snapped into the snap receiving element 160 formed in the base portion of the thong footwear. The snap attachment is inserted and forcibly snapped into the snap receiving element in the top receptacle to secure the separating element to the base portion.

FIG. 42 is a side perspective view of the thong footwear with a third version of the connector elements connection means and a wedge heel base portion. The footwear of this version comprises base portion 12 having a top opening 108, top receptacle 110, sidewall openings 24 and hollow receptacles 26. It further comprises upper portion 112, toe separating element 114, and first and second strap elements 116*a*, 116*b* each having a first side end 118, an exterior side 124, an interior side 126, and a plurality of male connector elements 162 attached to the interior side 126 of each of the first and second strap elements 116*a*, 116*b*. Preferably, the male connector elements 162 are in the form of the connector element shown in FIG. 15B. When the upper portion is removably attached to the base portion, portion 122 of the toe separating element 114 is removably coupled within the top receptacle 110, and the male connector elements 162 are inserted directly into the corresponding sidewall openings 24 and inserted through and securely coupled to the corresponding sidewall hollow receptacles 26. With this version, no outer ends of the connector elements are visible, and while the upper portion and base portion are interchangeable, the connector elements are not interchangeable.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Although the present invention has been described with reference to certain preferred versions thereof, other versions of the invention are possible. In compliance with the statute, the invention described herein has been described in language more or less specific as to structural features. It should be understood, however, that the invention is not limited to the embodiments described herein or to specific features shown, since the means and construction shown, is comprised only of the preferred embodiments for putting the invention into effect. It is also understood that the phraseology and terminology employed herein are for the purpose of description and should not be regarded as limiting.

What is claimed is:

1. A footwear system with interchangeab1e portions comprising:

an interchangeab1e base portion having a genera1 shape to fit a human foot, wherein the base portion has a bottom surface, a top surface with a top opening and an adjacent recessed top hollow receptacle embedded in the base portion, opposed sidewalls extending between and connecting the top and bottom surfaces, and a plurality of spaced openings formed in each of the sidewalls, where each opening has an adjacent hollow sidewall receptacle embedded in the base portion;

an interchangeable upper portion adapted for removable attachment to the base portion, the upper portion having a toe separating element and first and second strap elements each extending longitudinally from the toe separating element, wherein the first and second strap elements each have an exterior side, an interior side, a first side end having a plurality of spaced openings in the first side end, and a female connector element adjacent each of the side end openings and positioned on the interior side of each of the strap elements; and, a plurality of interchangeable male connector elements each having an inner end, an outer end, a body, and a projection member coupled to the body near the inner end, such that when the male connector element is inserted into the corresponding female connector element, the projection member releasably attached the male connector element to the female connector element, and wherein when the upper portion is removably attached to the base portion, a portion of the toe separating element is removably coupled within the top receptacle, and the attached male and female connector elements are inserted through the plurality of sidewall openings and are inserted through and coupled to the corresponding hollow sidewall receptacles, so that only the outer ends of the male connector elements are visible, and wherein the toe separating element is coupled within the top receptacle via a turnlock attachment element.

2. The footwear system of claim 1 further including decorative elements coupled to one or more of the outer ends of the connector elements.

3. The footwear system of claim 1 wherein the base portion comprises a heel portion selected from the group comprising a flat heel, a wedge heel, and a stacked heel.

* * * * *